United States Patent [19]

McCaffrey

[11] Patent Number: 4,903,913

[45] Date of Patent: Feb. 27, 1990

[54] KNOCK-DOWN SPOOL ASSEMBLY

[75] Inventor: James A. McCaffrey, Alpharetta, Ga.

[73] Assignee: Advanced Products Incorporated, Pittsburgh, Pa.

[21] Appl. No.: 227,376

[22] Filed: Aug. 2, 1988

Related U.S. Application Data

[63] Continuation of Ser. No. 86,276, Aug. 17, 1987, abandoned.

[51] Int. Cl.[4] ..... B65H 75/18

[52] U.S. Cl. ..... 242/115; 242/118.6

[58] Field of Search ..... 242/118.6, 118.61, 118.4, 242/115, 116, 71.8

[56] References Cited

U.S. PATENT DOCUMENTS

| | | | |
|---|---|---|---|
| 1,119,552 | 12/1914 | Trent | 242/118.6 |
| 1,152,278 | 8/1915 | Bowen | 242/118.61 |
| 3,552,677 | 1/1971 | Hacker | 242/118.61 |
| 3,785,584 | 1/1974 | Crellin, Jr. | 242/118.6 |
| 3,822,841 | 7/1974 | Campbell | 242/115 |
| 3,846,887 | 11/1974 | Woods et al. | 242/115 X |
| 4,128,215 | 12/1978 | Underwood | 242/118.61 |

FOREIGN PATENT DOCUMENTS

| | | | |
|---|---|---|---|
| 464623 | 12/1968 | Switzerland | 242/118.61 |
| 242047 | 11/1925 | United Kingdom | 242/118.61 |

*Primary Examiner*—Stanley N. Gilreath

*Attorney, Agent, or Firm*—Webb, Burden, Ziesenheim & Webb

[57] ABSTRACT

An improved knock-down spool assembly is disclosed including a spindle body having specially configured end projections and a pair of end plates for receipt thereof. The end projections provide a restraining surface that, upon being yieldingly received by an opening in the end plates, is captured to secure the spindle thereto. A second embodiment is provided with radial extending yielding detents upon the spindle body and matingly positioned openings to further secure the spindle body with the end plates. The invention is snapped together to form an integral, yet readily disassembled, spool.

7 Claims, 4 Drawing Sheets

KNOCK-DOWN SPOOL ASSEMBLY

This application is a continuation of application Ser. No. 086,276, filed Aug. 17, 1987, now abandoned.

TECHNICAL FIELD

The present invention relates to spools for carrying wound filaments or strands and, more particularly, relates to a knock-down spool assembly.

BACKGROUND OF THE INVENTION

Spools are a well known device for carrying and dispensing wound filaments, strands and the like. Spools are typically constructed of a spindle extending between two end pieces. A filament or strand is wound about the spool and, as needed, dispensed therefrom. Spools are used for a variety of materials, ranging from light weight threads to heavy metal cables. The spool must therefor be sufficiently rigid to support not only the weight of the spool itself, but to withstand the centripetal force exerted against it as a result of rapid unwinding of such varied types of wound material.

It is desirable that the spool be reusable. This often necessitates removal of the end pieces of tne spindle so that any residual material can be removed. Spools that can be so disassembled are often referred to "knock-down" spools and their use is well known. Even so, the use of knock-down spools for relatively heavy filaments or other like materials injects a tension into their construction. The spool must be sufficiently rigid to support the material and the spool itself, but also constructed so as to be readily disassembled.

Several spool assemblies known in the prior art purport to resolve this tension. U.S. Pat. No. 1,234,150 to Glaser discloses a spool formed of a spindle and two circular end flanges. Each end flange includes an inwardly projecting plug fitted with three hook-like rod elements. These elements serve to insure attachment of the plug to the end flange.

U.S. Pat. No. 3,905,561 to Kelch et al. discloses a tape carrier having a hollow core constructed separately from the end flanges. The core defines three recesses equally spaced about its axis. Each flange includes three resilient latches disposed and spaced peripherally of the core's aperture so as to secure the flange to the core for rotation therewith.

U.S. Pat. No. 4,128,215 to Underwood discloses a textile spool consisting of a pair of removable plugs inserted into the end of a hollow spindle. Each plug includes a flange and a tongue element. The tongue provides a raised projection positioned for engagement with an opening in the spindle. This arrangement provides for the plugs to be lockingly engaged with the spindle.

While each of these and the many other prior art spools purport to resolve the above described tension, several problems remain. Often, the fit between the various component parts is either loose initially or becomes so over time. This is typically due to the fact that such prior art spools do not positively interlock the end pieces to the spool. It is also sometimes due to the relatively complex arrangement of component parts provided by prior art spools. In an effort to overcome these problems, the components are often attached together utilizing an adhesive solvent or an ultrasound welding technique. While such techniques insure a tight fit, their use is expensive in both material and labor, and therefore, generally undesirable. Furthermore, once the components are so bounded together, they cannot be disassembled without breaking either the bond or the component.

Thus, there exists a need for a knock-down spool formed of a minimum number of parts that is not only easily assembled and tightly fit together, but can be easily disassembled and reassembled.

SUMMARY OF THE INVENTION

The present invention solves the above-described problems in the prior art by providing a knock-down spool assembly wherein the parts yieldingly snap together to insure a tight fit and a rigid spool, but are easily disassembled and reassembled so as to render the spool reusable.

Generally described, a first preferred embodiment of a spool assembly according to the present invention comprises a spindle and at least one end flange. The spindle includes at least one end projection about its longitudinal axis. The end flange defines a matingly shaped receptacle that yieldingly receives and retains the spindle end projection. A second preferred embodiment is disclosed wherein the spindle further includes at least one radial projection received by an inwardly projecting hub.

Thus, it is an object of the present invention to provide an improved knock-down spool assembly.

It is a further object of the present invention to provide an improved spool knock-down spool assembly formed of interlocking component parts.

It is a further object of the present invention to provide a knock-down spool assembly formed of component parts that yieldingly fit together so as to form a rigid integral unit.

It is a further object of the present invention to provide a knock-down spool assembly wherein the spindle is locked directly to the end flange of the spool.

It is a still further object of the present invention to provide a knock-down spool assembly wherein the spindle is locked directly to both the end flange and the hub of the spool.

These and other objects, feature and advantages of the present invention will become apparent upon reading the following specification in conjunction with the accompanying drawings.

DETAILED DESCRIPTION

Figure 1:
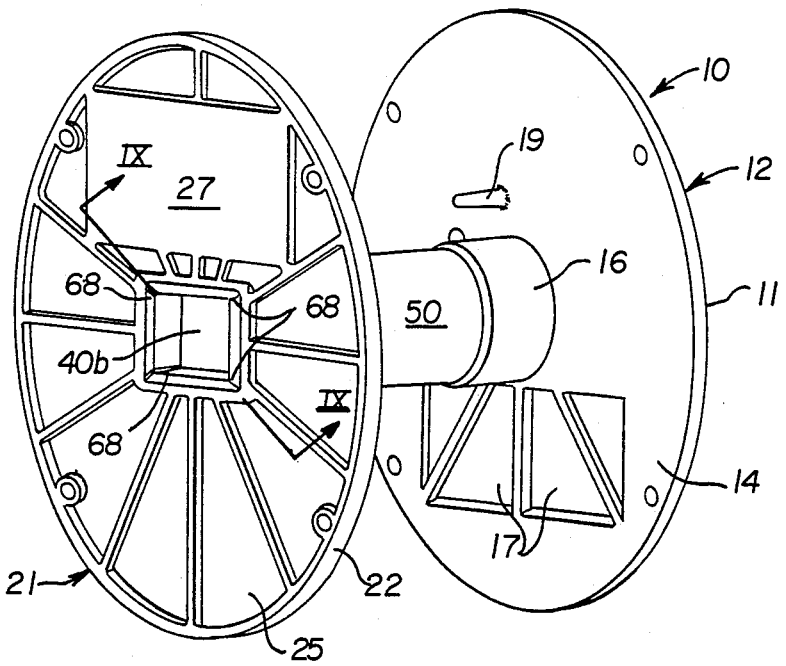
FIG. 1 is a perspective view of a first preferred embodiment of a spool assembly according to the present invention.
Figure 2:
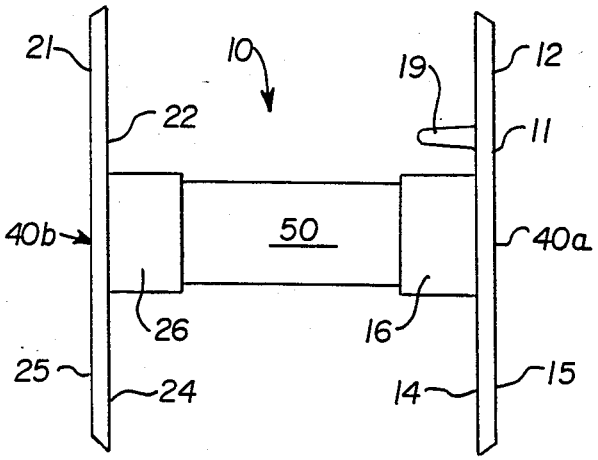
FIG. 2 is a front elevational view of the embodiment shown in FIG. 1.
Figure 3:
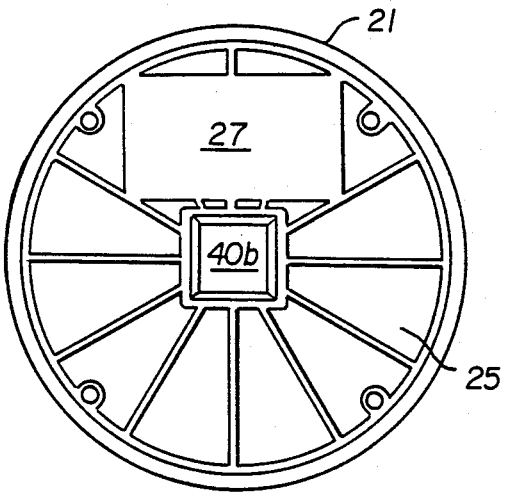
FIG. 3 is a left end elevational view of the embodiment shown in FIG. 1.

Referring now in more detail to the drawings, in which like numerals indicate like parts throughout the several views, FIG. 1 shows a first preferred embodiment of a spool assembly according to the present invention. This first preferred embodiment of the spool assembly, indicated generally at 10, is formed with a right end plate 11 and a left end plate 21 connected by a hollow spindle body 50. As described in detail hereinbelow, these components snap together to form an integral unit that is easily assembled, snugly fit together and easily disassembled.

The right end plate 11 is formed having a flange 12 and an integrally formed hub 16. The right end plate 11 is a circular, disc-like member defining a first or inside surface 14 and a second outside surface 15. The hub 16 is hollow and, as described in greater detail below, is formed for receipt of the end portion of the spindle body 50. A window or marking surface 17 is provided in the inside surface 14 of the right end plate 12. The window or marking surface 17 may either by transparent or opaque. A transparent surface is to be provided if it is desired to look through the window 17 to determine the amount of material on the spool 10. An opaque surface is to be provided if it is desired only to identify the type of filament wound about the spool. The right end flange 12 further provides an inwardly projecting finger 19. The finger 19 is integrally formed with the right end plate 11 and is utilized to secure a filament about the spool 10 in a conventional manner. The right end flange 12 may be formed of any suitably rigid material. A preferred material is a polyurethane, polystyrene, or other rigid, yet measuredly pliable plastic material.

The left end plate 21 is substantially identical to the right end plate 12. The left end plate 21 is formed with a circular, disc-like end flange 22 and an inwardly projecting cylindrical hub 26. The hub 26 is also hollow for recept of an end portion of the spindle body 50. The left plate 21 defines a first of inside surface 24 and a second or outside surface 25. The left end flange 22 also includes a window or marking surface 27. This surface 27 is similar to the surface 17 of the right end plate 11 in that it may be either transparent or opaque depending on the desired purpose.

Figure 6:
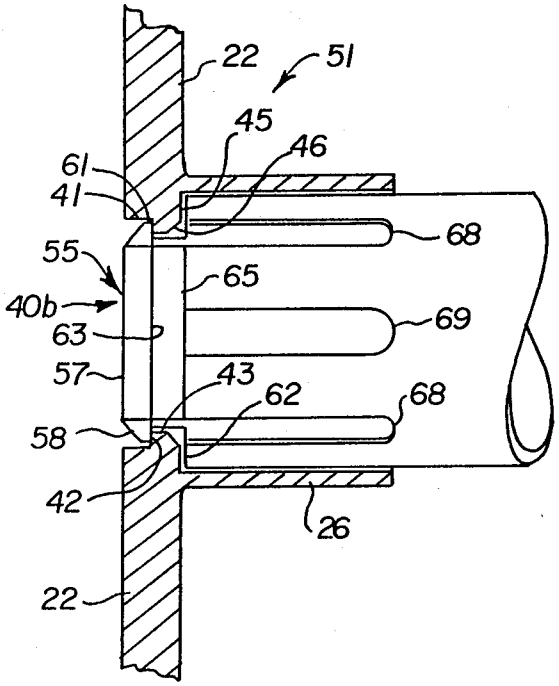
FIG. 6 is a partial view of the embodiment shown in FIG. 1, showing in particular the left end plate in engagement with the spindle.
Figure 9:
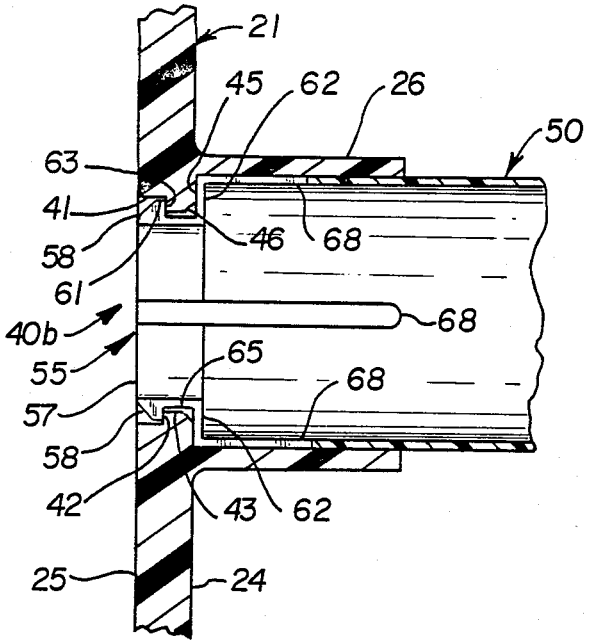
FIG. 9 is a partial cross-sectional view of the left end plate in engagement with the spindle taken along line IX—IX of FIG. 1.

The center portion of the circular plates 11 and 21 are indicated at **40*a* and 40*b*, respectively. The center portions 40*a* and 40*b* are shown in the drawing as rectangular openings defined by the end plates 11 and 21. The center portions 40*a* and 40*b* are identical in construction and thus only one is described in detail. The center portion 40*b* of the first disclosed embodiment of the invention is shown in cross-section in FIG. 6 and FIG. 9. The outside surface 25 of the plate 21 defines a portion with a floor 42 surrounded by a wall 41. (Although the portion is shown in the drawings as being rectangular, it may be circular, octagonal or of any other suitable shape.) The center portion 40*b* of the plate 21 is further defined by an inner edge wall 43 that connects with the floor 45 of the hub 26 by a beveled edge 46. Of course, the center portion 40*a* of the plate 11** is of a mirror-like construction.

Figure 7:
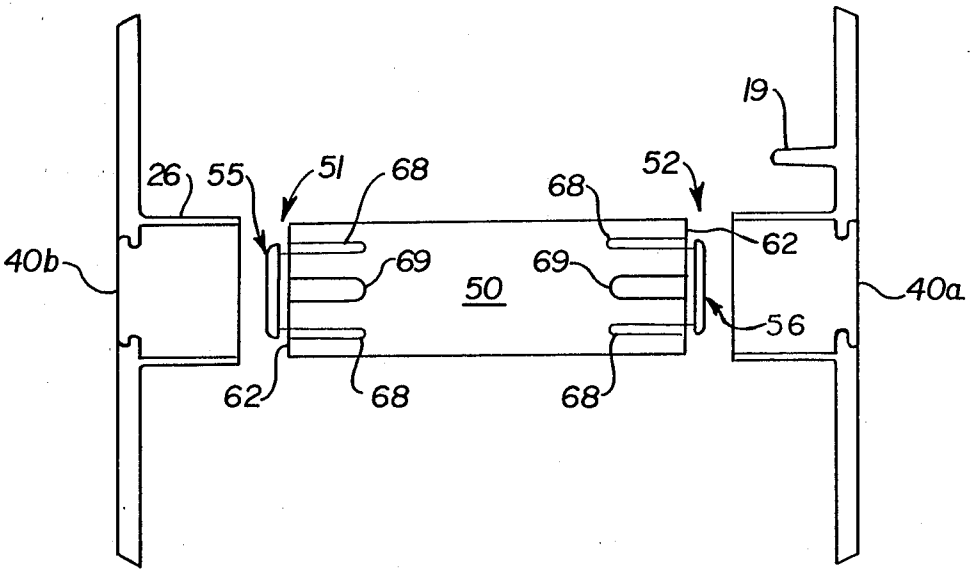
FIG. 7 is an exploded front elevational view of the embodiment shown in FIG. 1.
Figure 8:
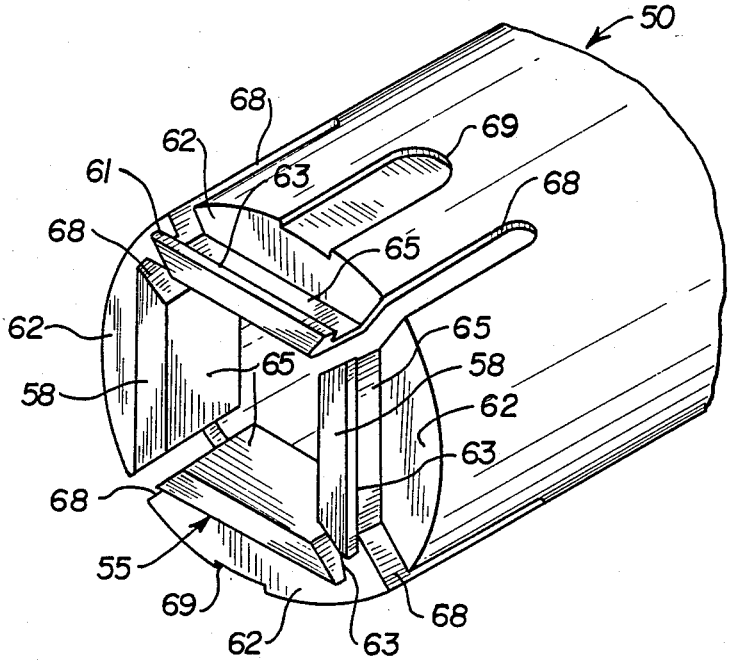
FIG. 8 is an enlarged partial perspective view of the left end of the spindle shown in FIGS. 1–3 and 6 and 7.

The spindle body 50 is a hollow cylindrical member defining a left end portion 51 and a right end portion 52. As shown best in FIG. 7 and FIG. 8, each end portion is formed with a plurality of axial notches 68 and guide slots 69. The spool 10 is assembled by inserting the left end portion 51 into the center portion **40*b* of the left end plate 21 and the right end portion 52 into the center portion 40*a* of the right end plate 11. The end portions 51 and 52 of the spindle body 50 are each provided with an integrally formed projection or beveled wall portion 55 and 56, respectively. The projections 55 and 56** are identical in construction, and therefore, only one will be described in detail.

End projection or beveled wall portion 55 has an outer wall 57 with a beveled edge 58. The beveled edge 58 is formed to connect with an outer edge 61 of the projection 55 that, upon assembly of the spool 10, rests adjacent the wall 41 of the end plate 21. The end projection 55 is also formed with an annular restraining surface 63 and a spacer portion 65. A flat transistional surface or wall 62 extends radially inward from the cylindrical sidewall of the spindle body 50 to join the rectangularly arranged, flat surfaced spacer portions 65, see FIGS. 6–9, and particularly FIG. 8. Wall 62 and end projections 55 are radially yieldable by virtue of axial notches 68. The four flat surfaces presented by the inner edge wall 43 of the rectangular or square-shaped open portion **40*b* of the end plate 21 will register with the four flat surfaces presented by the spacer portions 65 of the spindle locking projections 55 to prevent rotation between the spindle 50 and end plate 21 when the parts are interlocked. As shown in the drawing, the restraining surface 63 is captured by the floor 42 defined by the surface of the center portion 40*b* of the end plate 21. It is to be noted that the dimension of the spacer portion 65 of the projection 55 is substantially equal to the distance between the floor 45 of the hub 26 and the surface or floor 42** on the end plate. Assembly of this first preferred embodiment is described in detail hereinbelow.

Figure 5:
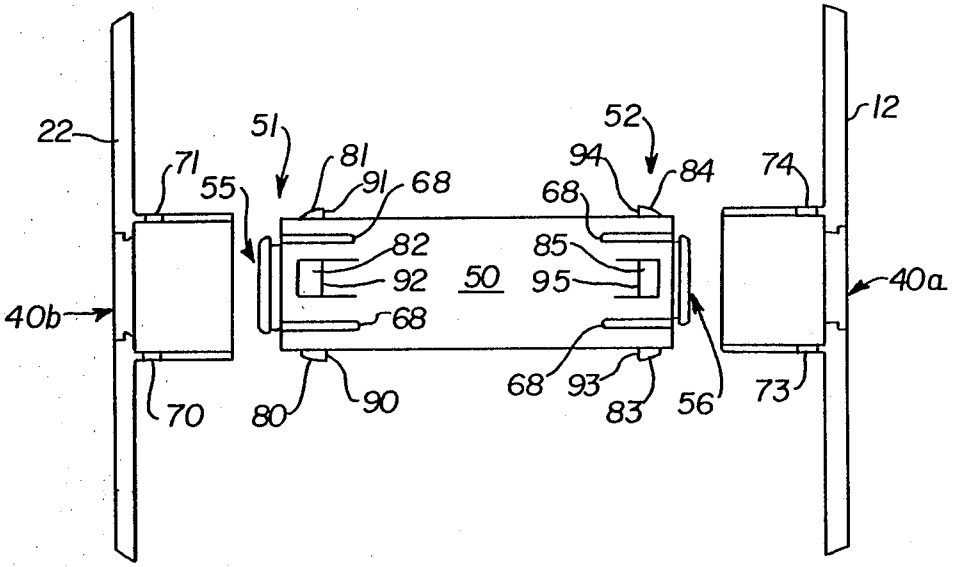
FIG. 5 is an exploded front elevational view of the second embodiment of the present invention.
Figure 4:
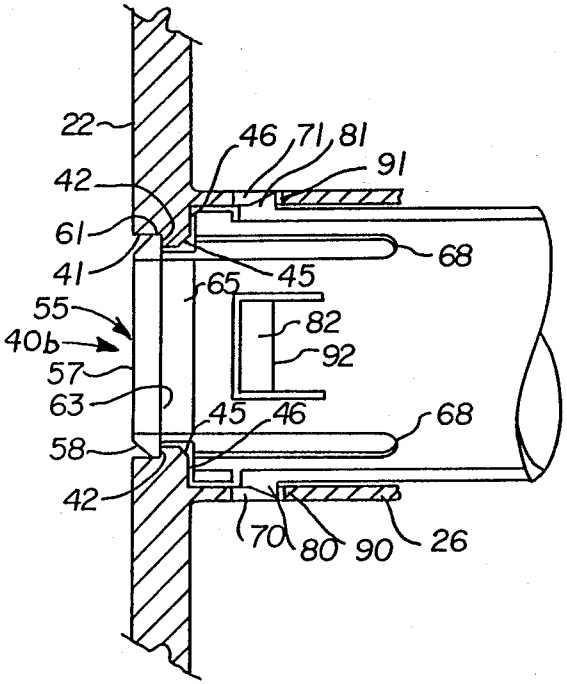
FIG. 4 is a partial view of a second preferred embodiment of a spool assembly according to the present invention, showing the engagement of the spindle to the left end plate thereof.

A second preferred embodiment of the present invention is shown in FIGS. 4 and 5. It will be readily seen from a review of these drawing figures that the elements of the invention as recited hereinabove are found in this second embodiment. However, there are certain modifications to be noted. The hubs 16 and 26 of the end plates have been provided with openings 70, 71 and 73, 74 (additional and like openings are not shown). The end portions of the spindle body 50 of this second embodiment has been provided with radially projecting and yielding detents, 80, 81, 82, 83, 84 and 85. Each detent defines a lower restraining lip 90–95, respectively, that further secures the end plates 11 and 21 to the spindle body 50 as described hereinbelow.

Cooperation of these additional elements of the second embodiment is shown in FIG. 4. The end projection 55 is inserted into the center portion **40*b* of the plate 21 (as well as the end projection 56 being inserted into the center portion 40*a*) as described hereinabove. However, in addition to the cooperation of restraining surface 63 and floor 42, the spindle body 50 of the second embodiment is further secured to the end plates 11 and 21** by extension of the detents into the openings, respectively, as shown in FIG. 4. The restraining lip on each provides further positive locking action.

Assembly of the first embodiment of the knock-down spool of the present invention is as follows. The right end plate 11 is first positioned about the spindle body 50 so as to align the spindle right end projection 56 with the center portion 40*a* of the plate. The plate 11 is then engaged to the spindle body 50 by inserting the spindle into the hub 16. The beveled edge 58 of the end projection 56 will yieldingly engage the beveled edge 46 of the end plate center portion 40*a*. The beveled edges 58 carried by the end projections 55 and 56 are radially yieldable due to the combined flexing action provided by the pliable plastic material of construction and due to the clearance provided by axial notches 68 formed through the spindle 50 at the corners of the beveled edges 58, as best seen in FIGS. 1, 7, 8 and 9. This permits the end projection 56 to pass yieldingly the innermost indented wall of the plate 11 and be retained by engagement of the restraining surface 63 with the end plate center portion 42. The same operation is repeated for the left end plate 21 and left end projection 55 to provide an assembled spool as shown (in partial) in FIG. 6.

The identical assembly steps are taken for the second disclosed embodiment. However, the spindle body 50 is yet further secured to the end plates 11 and 21 by the detents 80–85. The detents 80–85 are formed of arrow-like or hook-like shape so as to facilitate insertion of each into the hubs 16 and 26. The detents 80–85 are thus yieldingly received by the hubs 16 and 26 and the end plates 11 and 21, respectively. As shown in FIG. 4, the detents 80 and 81 are positioned for receipt by the openings 70 and 71, respectively, in the hub 26. It is to be appreciated that each detent 80–85 is positioned for such receipt by its respective opening, and that as many such detents as desired may be utilized. Once the end projection 55 is fully inserted into the center portion 40*b*, the detents 80–82 spring into their respective openings such that respective surfaces 90–92 act as retaining surfaces. Similarly, once the detents 83–85 spring into their respective openings, the restraining lips 93–95, respectively, provide the positive interlocking effect.

The assembled spool 10 of either embodiment is readily disassembled by disengaging the retaining surfaces. For example, a tool such as a screwdriver may be used to pry end restraining surface 63 from floor 42. Similarly, the restraining surface 91 of the second embodiment may be disengaged by depressing detent 81 within opening 71. The end plates 11 and 21 are then pulled apart from the spindle body 50 to disassemble the spool 10.

Thus, it is seen that the present invention enjoys the advantage over prior art spools in that the component parts may be quickly and securely snapped together to form an integral unit. Furthermore, the spool 10 may be readily disassembled by disengaging the restraining surfaces of the individual components one from the other.

This specification has thus described two preferred embodiments of the present invention, including the steps necessary for fabricating these preferred embodiments. It is to be understood, however, that numerous changes and variations could be made in the construction of the present container within the spirit of the present invention. It should therefore be further understood that the foregoing specification relates only to said preferred embodiments of the present invention and that modifications may be made therein without departing from the scope thereof as set forth in the appended claims.

I claim:

1. An improved knock-down spool assembly comprising an elongated cylindrical spindle body having a cylindrical sidewall, a hollow interior and opposed cylindrical end portions, each end portion having an axially projecting, radially yieldable locking means including a flat transitional surface extending radially inwardly from the cylindrical sidewall, at least one spacer portion forming a flat anti-rotation surface and an edge portion having a restraining surface; a pair of spaced-apart end plates detachably interlocked to respective end portions of said spindle body, each end plate having first and second surfaces and having a cylindrical hub formed on and extending substantially normal to said second surface to receive an end portion of said cylindrical spindle body therein, each end plate having a through opening formed within an area surrounded by said hub including means formed in said opening to interlock with the yieldable locking means carried by said spindle body, said end plates each having at least one flat surface formed in said hub opening to register with said at least one spacer portion of said locking means of the spindle body between said flat transitional surface and said restraining surface, whereby engagement of each end portion on said spindle body with an end plate positively interlocks the end plates to said body to form a spool assembly and registry of said at least one flat anti-rotation surface of said spacer portion of said locking means on said spindle body and said flat surfaces formed in said hub openings on said end plates prevents relative rotation between said spindle body and said end plates.

2. The spool assembly of claim 1 wherein the axially projecting yieldable locking means of the spindle body has a cross section in the form of a closed geometric shape defined by a plurality of spacer portions forming flat anti-rotation surfaces thereon and wherein the hub opening formed through each of the end plates has a geometric shape defined by a plurality of flat surfaces corresponding to those of the spindle body to register with said plurality of flat surfaces of the spindle body.

3. The spool assembly of claim 2 wherein the form of the geometric shape of the locking means and the end plate openings is that of a rectangle.

4. A spool assembly as set forth in claim 1 including a window in at least one of said end plates.

5. An improved knock-down spool assembly comprising an elongated cylindrical spindle body having a cylindrical sidewall, a hollow interior and opposed cylindrical end portions, each end portion including axially projecting, radially yieldable locking means and having at least one flat anti-rotation surface formed thereon; a pair of spaced-apart end plates detachably interlocked to respective end portions of said spindle body, each end plate having first and second surfaces and having a cylindrical hub formed on and extending substantially normal to said second surface to receive an end portion of said cylindrical spindle body therein, each end plate having a through opening formed within an area surrounded by said hub including means formed in said opening to interlock with the yieldable locking means carried by said spindle body, said end plates each having at least one flat surface formed in said hub opening to register with said at least one flat surface carried by said locking means of the spindle body, whereby engagement of each end portion on said spindle body with an end plate positively interlocks the end plates to said body to form a spool assembly and registry of said at least one flat surface on said spindle body and on said end plates prevents relative rotation between said spindle body and said end plates, the sidewall of each end portion of said spindle body having at least one yieldable outwardly extending detent formed thereon and each hub on said end plates having an opening formed therein to receive a detent when said spindle body and said end plate are positively interlocked.

6. A spool assembly as set forth in claim 5 wherein one end of each of said detents is formed with an outwardly directed beveled surface to facilitate insertion of the end portions of said spindle body into a hub and the other end of each detent is formed with a restraining lip spaced from said outwardly directed beveled surface on each detent.

7. An improved knock-down spool assembly comprising an elongated cylindrical spindle body having a cylindrical sidewall, a hollow interior and opposed cylindrical end portions, each end portion having an axially projecting, radially yieldable locking means including a flat transitional surface extending radially inwardly from the cylindrical sidewall, four spacer portions forming a cross section in the form of a rectangle of four flat anti-rotation surfaces and an edge portion having a restraining surface; a pair of spaced-apart end plates detachably interlocked to respective end portions of said spindle body, each end plate having first and second surfaces and having a cylindrical hub formed on and extending substantially normal to said second surface to receive an end portion of said cylindrical spindle body therein, each end plate having a through opening formed within an area surrounded by said hub including means formed in said opening to interlock with the yieldable locking means carried by said spindle body, said end plates each having four flat surfaces formed in said hub opening to register with said four spacer portions of said locking means of the spindle body between said flat transitional surface and said restraining surface, whereby engagement of each end portion on said spindle body with an end plate positively interlocks the end plates to said body to form a spool assembly and registry of the flat anti-rotation surfaces of said spacer portions of said locking means on said spindle body and said flat surfaces formed in said hub openings on said end plates prevents relative rotation between said spindle body and said end plates.

* * * * *